US006719160B2

(12) United States Patent
Sen-Yih

(10) Patent No.: US 6,719,160 B2
(45) Date of Patent: Apr. 13, 2004

(54) BOTTLE STOPPER

(75) Inventor: Lin Sen-Yih, Tainan Hsien (TW)

(73) Assignee: Sunlot Bottle Stopper Co., Ltd. (TW)

( * ) Notice: Subject to any disclaimer, the term of this patent is extended or adjusted under 35 U.S.C. 154(b) by 255 days.

(21) Appl. No.: 09/964,552

(22) Filed: Sep. 28, 2001

(65) Prior Publication Data

US 2003/0062331 A1 Apr. 3, 2003

(51) Int. Cl.[7] ..... B65D 39/12
(52) U.S. Cl. ..... 215/361; 215/364; 220/234
(58) Field of Search ..... 215/358–361, 215/364, 295, 296, 299, 279; 220/234–238

(56) References Cited

U.S. PATENT DOCUMENTS 2,705,573 A * 4/1955 Zepelovitch ..... 215/361
2,718,974 A * 9/1955 Helbig ..... 215/360
3,638,821 A * 2/1972 Guala ..... 215/253
3,926,329 A * 12/1975 Guala ..... 215/361
6,536,618 B1 * 3/2003 Hwang et al. ..... 215/358

FOREIGN PATENT DOCUMENTS

FR 2572719 * 5/1986

* cited by examiner

*Primary Examiner*—Nathan J. Newhouse
(74) *Attorney, Agent, or Firm*—Bacon & Thomas, PLLC

(57) ABSTRACT

A bottle stopper for sealing and resealing a bottle neck. The bottle stopper includes a body, a plug and a jacket. The body includes legs and axially guiding grooves thereof provided on its inner circumference. The plug includes axially positioning ribs adapted to engage with the corresponding axially guiding grooves in order to increase reliability of the combined structure. A combined body and plug member is inserted into the jacket to form a bottle stopper. When the radially inner flange is engaged with the groove, the plug cannot be removed from the body. As the plug is axially pressed into the body, the radial inner flange is then disengaged with the groove, and the outer circumference of the jacket may radially expand to seal or to reseal a bottle.

14 Claims, 9 Drawing Sheets

BOTTLE STOPPER

BACKGROUND OF THE INVENTION

1. Field of the Invention

The present invention is related to a bottle stopper having a simplified structure, and more particularly to the bottle stopper for enhancing sealing effect and increasing reliability at reduced cost.

2. Description of the Related Art

Liquor, wine or the like is conventionally contained in glass or ceramic bottle. Before the bottling process, distilled heat liquor has already situated in high inner pressure. In the bottling process, when the traditional plug is typically forced into the neck of a filled bottle, the inner pressure in the filled bottle is essentially greater than atmospheric pressure. Typically, the diameter of plug is apt to slightly greater than the inner circumference of the bottle neck in order to sealably confront each other when the plug is axially inserted into the bottle neck. The plug, therefore, is capable of withstanding substantial inner pressure over long storage periods without deterioration or effect on the contents. During the bottling process, it is hard while the plug is inserted as intended into the bottle neck. In particular, the plug is hard to be remained in the bottle neck by an axially directed inner pressure from within the bottle.

There is a serious problem in the market. Illegal factories fabricate fake liquor or wine by using the used bottles and plugs on which covering a new and intact cap of tinfoil or a plastic material. Accordingly, there is a need of performing the function of indicating whether or not the bottle has previously been opened. Therefore, one of solutions for such function is preventing the plug from illegally reusing.

A number of bottle stoppers or the likes have been provided in the prior art, see for example U.S. Pat. Nos. 2,021,259, 2,718,974, 3,430,777, 3,638,821, 5,722,548, 5,732,837, 4,902,270, which are incorporated herein by reference.

In U.S. Pat. No. 2,021,259 discloses a bottle closure of the composite expanding stopper type. The bottle closure comprises a hollow rubber stopper, a slidable plunger, and a rib (cooperating means) on the stopper and plunger operating to automatically expand the stopper.

In U.S. Pat. No. 2,718,974 discloses an expansion stopper for sealing the neck of neck of bottle and like container. The bottle closure comprises an outer cup-like expansible body, an upper peripheral flange and a conical plug.

In U.S. Pat. No. 3,430,777 discloses stopper-type plastic cap has means for selectively applying outward radial pressure to engage the interior surface of bottle necks for sealing, resealing and resealing the bottle. An integral annular tear strip locks the cap in a sealed condition by a snap-in undercut groove when the cap is initially applied to the neck by a downward force and requires tearing off for initial release. Compressible means is located on a surface of a radial flange extending across the bottle mouth and coacts with the outward radial pressure applying means to accommodate varying dimensions of the bottle neck.

In U.S. Pat. No. 3,638,821 discloses a closure for a container with an internal undercut in its neck consisting in a flexible main member and rigid auxiliary member. The main member has a top flange which seats on the mouth of the container and a stopper portion in the form of an inner and an outer coaxial wall, separated by a clearance. A bulge is formed on the outer surface of the outer wall, and when the closure is fitted in place engages in the undercut. The auxiliary member has a tubular wall which extends into the clearance, with an external annular projection near its end. When the closure is in place the two annular projections are aligned, and the closure cannot be removed intact. For removal, the auxiliary member is pressed further in to force the projection on its tubular wall to pass the projection on the outer wall of the main member and allow the main member to be deformed and withdrawn.

In U.S. Pat. No. 5,722,548 discloses combination of a bottle stopper and stopper-remover comprising cylindrical stopper means of resilient material, a hollow sleeve, and puller means for insertion into the sleeve.

In U.S. Pat. No. 5,732,837 discloses a closure member for use in closing vials that are subjected to lyophilization conditions where the member is a resilient stopper that has a plug movable within a passageway in the stopper. The plug is movable between a first raised venting position and second downwardly engaging, sealing position whereby fluid from the vial or container is precluded from flowing through the fluid passageway in the cap. The passageway has a venting medium filter covering it which allows passage of water vapor, but not bacteria.

In U.S. Pat. No. 4,902,270 discloses a centrifuge tube assembly comprising a centrifuge tube and an inserter for placement within the neck portion of the centrifuge tube. The insert has a rigid portion and pliable portion.

Applicant PCT application PCT/US00/28866 discloses a bottle plug mainly including a bottle plug member and an elastomer member. The bottle plug member consists of a gas-tight means and a reuse-proof means and further inserts into the elastomer member being assembled as a unit to form the bottle plug. When the bottle plug is inserted into a bottle neck, the gas-tight means provides an expansion portion to seal the bottle neck and the reuse-proof means provides an appearance and the function of indicating whether the bottle neck has previously opened or the bottle plug has been used. However, a need exists for improved the construction of integrated such bottle plug elements and facilitating their operation. Meanwhile, another need exists for a structure of bottle plug that will not involve any mutilation or destruction of its element so that it may be reused or re-sealed.

The present invention intends to provide a bottle stopper including longitudinally positioning ribs and longitudinally guiding grooves structurally engaged therewith in such way to as to mitigate and overcome the above problems.

SUMMARY OF THE INVENTION

The primary objective of this invention is to provide a bottle stopper comprising of structurally simplified members in order to reduce operational/assembling steps in manufacture process.

The secondary objective of this invention is to provide a bottle stopper including longitudinally positioning ribs and longitudinally guiding grooves structurally engaged therewith for enhancing sealing effect and increasing reliability at reduced cost.

The present invention is the bottle stopper which includes a body, a plug and a jacket. The body comprises a plurality of legs and longitudinally guiding grooves thereof provided on its inner circumference. The plug comprises a plurality of longitudinally positioning ribs being adapted to engage with the corresponding longitudinally guiding grooves in order to increase reliability of structurally combining. Each leg further comprises a radially inner flange with relation to a common center and provided on its inner circumference.

Each longitudinally positioning rib further comprises a groove being adapted to engage with the corresponding inner radically inner flange in order to lock the longitudinally positioning rib within a space defined by the legs. A combined body and plug member is inserted into the jacket to form a bottle stopper. When the radially inner flange is engaged with the groove, the plug cannot be removed from the body. As the plug is axially pressed full-scale into the body and the radially inner flange is then disengaged with the groove, the outer circumference of the jacket may radially expanded to seal or to reseal a bottle neck.

Other objectives, advantages and novel features of the invention will become more apparent from the following detailed description and the accompanying drawings.

BRIEF DESCRIPTION OF THE DRAWINGS

The present invention will now be described in detail with reference to the accompanying drawings herein.

DETAILED DESCRIPTION OF THE INVENTION

Figure 1:
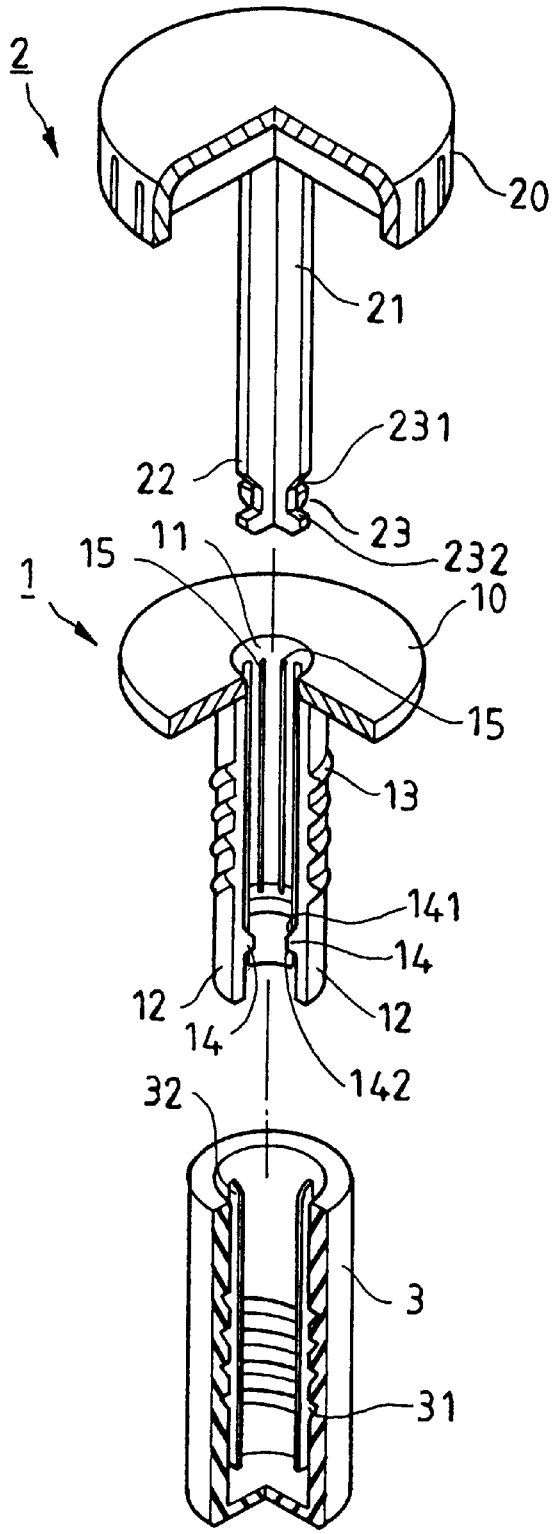
FIG. 1 is an exploded perspective view in partially cut-away of a bottle stopper in accordance with a first embodiment of the present invention.

Referring now to the drawings, there are two embodiments of the present invention shown therein, which include generally a body member, a plug member and a jacket member.

Figure 5:
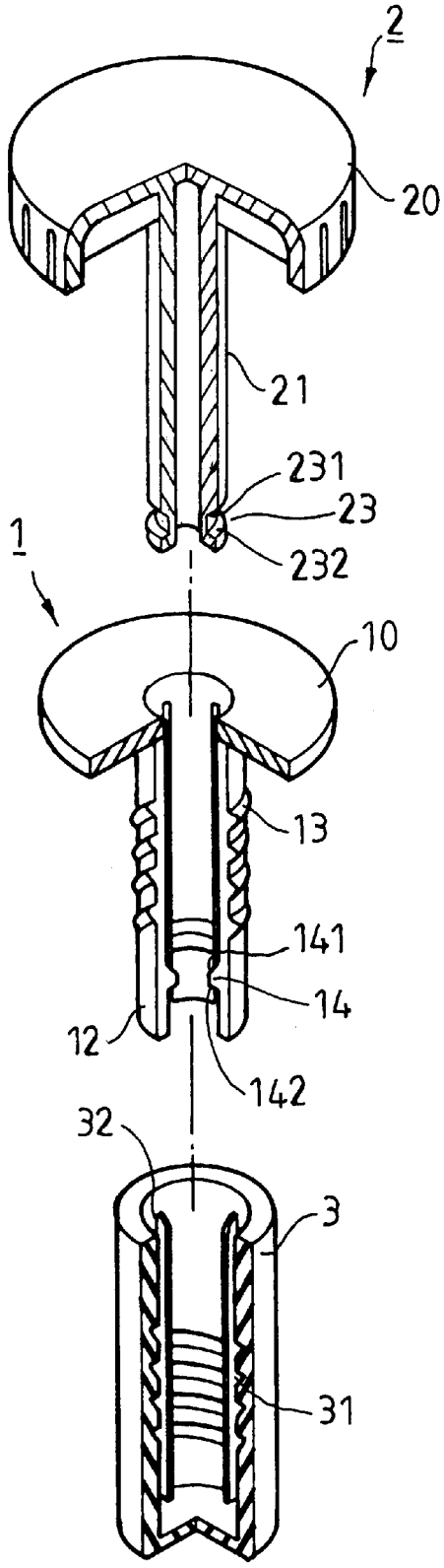
FIG. 5 is an exploded perspective view in partially cut-away of a bottle stopper in accordance with a second embodiment of the present invention.

Referring initially to FIGS. 1 and 5, a bottle stopper in accordance with the present invention generally includes a body designated as numeral 1, a plug designated as numeral 2, a jacket designated as numeral 3 and a bottle neck designated as numeral 4. The bottle neck 4 can be designed various shape somewhat by traditional and etiquette.

Figure 2:
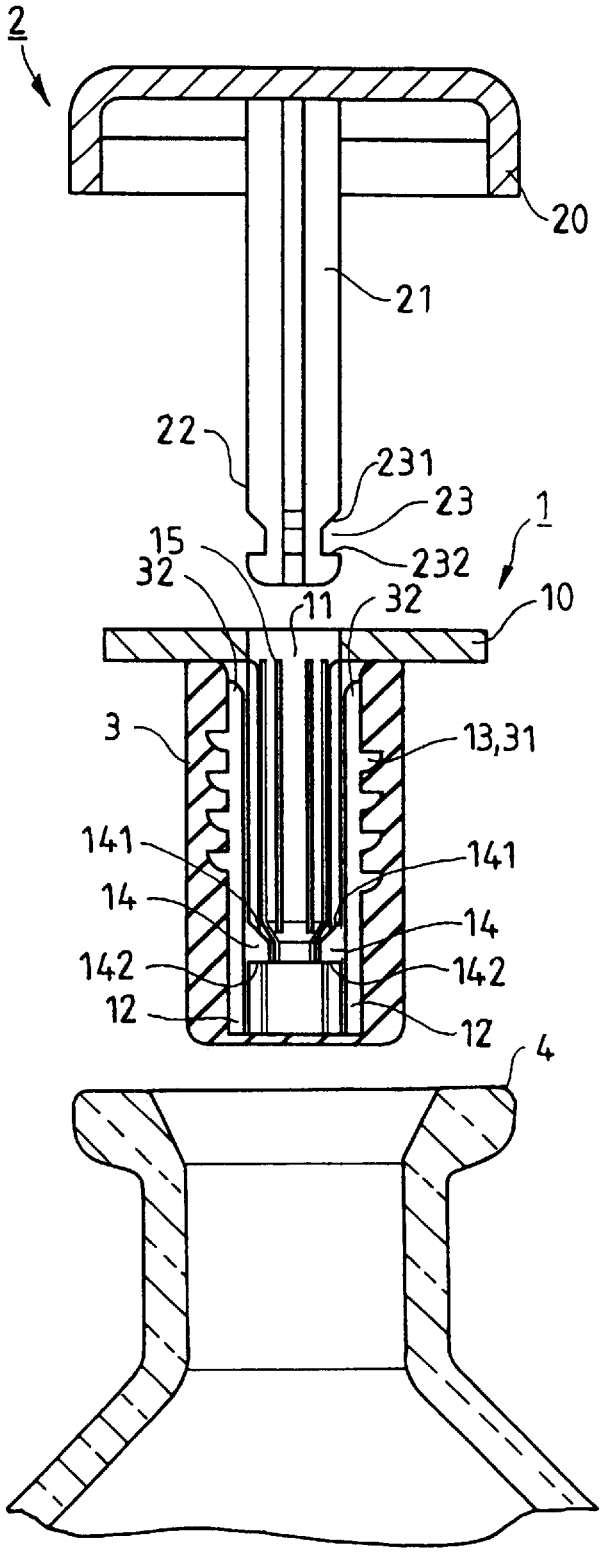
FIG. 2 is an exploded perspective, cross-sectional view of the bottle stopper in accordance with the first embodiment of the present invention.

Construction of the body 1 of the bottle stopper in accordance with the first embodiment of the present invention shall be described in detail, referring now to FIGS. 1 and 2. The body 1 comprises a top plate 10 and a plurality of flexible legs 12 thereof structurally connected with an underside of the top plate 10, molded as an integral member. Preferably, the four legs 12 divide a radially outer circumference of the body 1 into four identical sections which extends at least approximately 90° arc length or about ¼ of the total length. The top plate 10 has a hole 11 as well as a passage connecting with the space defined by the legs 12. An outer and inner circumference of each leg 12 provides a plurality of ribs 13 and a radially inner flange 14 respectively. The radially inner flanges 14 extend around a common longitudinal axis of the body 1 to form a primarily expanded portion. The radially inner flange 14 is positioned with relation to a common center proximate an end of the body 1 and consists of an upper-inclined surface 141 and a lower surface 142. The inner circumference of each leg 12 further provides longitudinally guiding grooves 15 extended from one end to another.

Construction of the plug 2 of the bottle stopper shall be described in detail, referring now to FIGS. 1 and 2. The plug 2 comprises a head 20 and a singular rod 21 thereof structurally connected with an underside of the head 20, molded as an integral member. The rod 21 consisted of a plurality of longitudinally positioning ribs 22 being adapted to engage with the corresponding longitudinally guiding grooves 15 in order to increase reliability of structurally combining. Preferably, the four longitudinally positioning ribs 22 separates a radially outer periphery of the plug 2 into four identical spaces in the range of at least approximately 90° arc length or about ¼ of the total length. In the design of plug 2 such as that constructed a plurality of ribs 22, it is a practice to save material and to reduce cost for manufacture. Each longitudinally positioning rib 22 further comprises a groove 23 being adapted to engage with the corresponding inner radically inner flange 14 in order to lock the longitudinally positioning rib 22 as well as the rod 21 within the space of the legs 12. The groove 23 consists of an upper inclined surface 231 and a lower surface 232.

Construction of the jacket 3 of the bottle stopper shall be described in detail, referring now to FIGS. 1 and 2. The jacket 3 may be made of cork, foamed plastic material, compressible material or the like which can prevent chemically contaminating the content within a bottle giving it a distressing taste and permits only a miniscule amount of dimensional expansion to seal the bottle neck. The jacket 3 is tube shaped as shown and comprises a plurality of radially annular groove 31 and a plurality of longitudinal ribs 32 provided on its inner circumference. An outer circumference of the jacket provides an expanded portion to seal a bottle neck.

Figure 3:
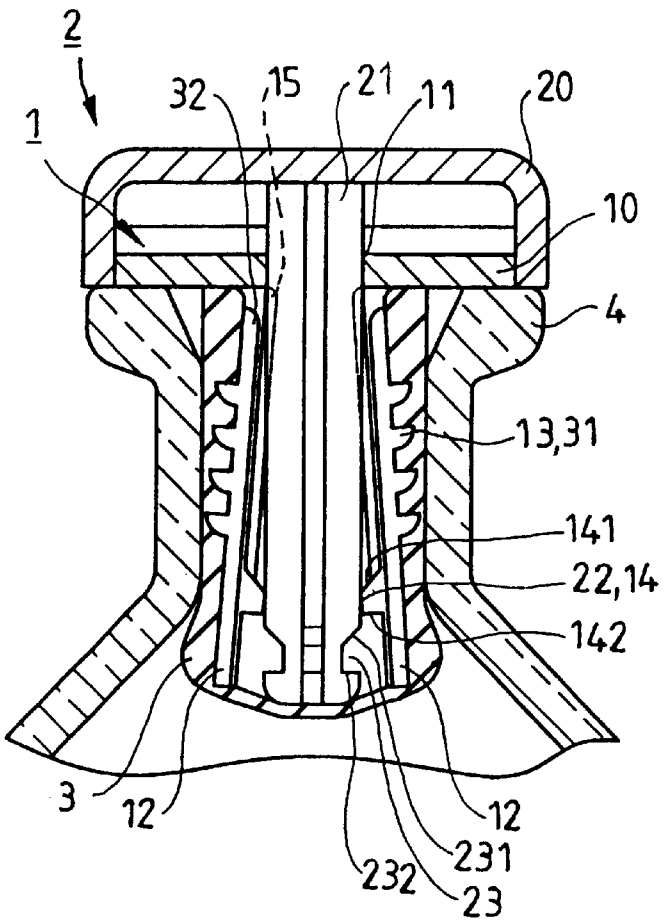
FIG. 3 is a cross-sectional view illustrating the bottle stopper in accordance with the first embodiment of the present invention in sealed position and showing the groove disengaged with the positioning rib.

Assembled operation of the bottle stopper in the bottle neck shall now be described with reference to FIGS. 1 through 3. The body 1 is co-axially inserted into a combined plug and jacket member to form a bottle stopper. As can be seen in FIG. 3, the ribs 13 of the body 1 are engaged with the radially annular groove 31 of the jacket 3 and each leg 12 of the body is positioned between the two longitudinal ribs 32. As the rod 21 of the plug 2 is inserted into the hole 11 of the body 1, the longitudinally positioning ribs 22 are engaged with the corresponding longitudinally guiding grooves 15 so that the plug 2 cannot rotate with respect to the longitudinal axis of the body 1. When the radially inner flange 14 is engaged with the groove 23, the engagement of the upper inclined surfaces 141 and 231 are slidable and then the plug 2 can move further into the body 1 if it is pressed. By contrast, the plug 2 cannot be removed from the body 1 because the engagement of the lower surfaces 142 and 232 are not releasable.

Sealed operation of the bottle stopper shall now be described with reference to FIGS. 1 through 3. The bottle stopper is initially inserted into the bottle neck 4. As the plug 2 is axially pressed full-scale or a predetermined distance into the body 1, the radially inner flange 14 is disengaged with the groove 23 such that the outer circumference of the jacket 3 may radially expanded to seal the bottle neck 4. In this manner, as the radially inner flanges 14 of the body 1 are engaged with the longitudinally positioning ribs 22 of the plug 2, the legs 12 are expanded radially outward with respect to the axis of the body 1. Accordingly, the outer circumference of the jacket 3 with a maximum diameter confronts with the inner circumference of the bottle neck 4.

Figure 4:
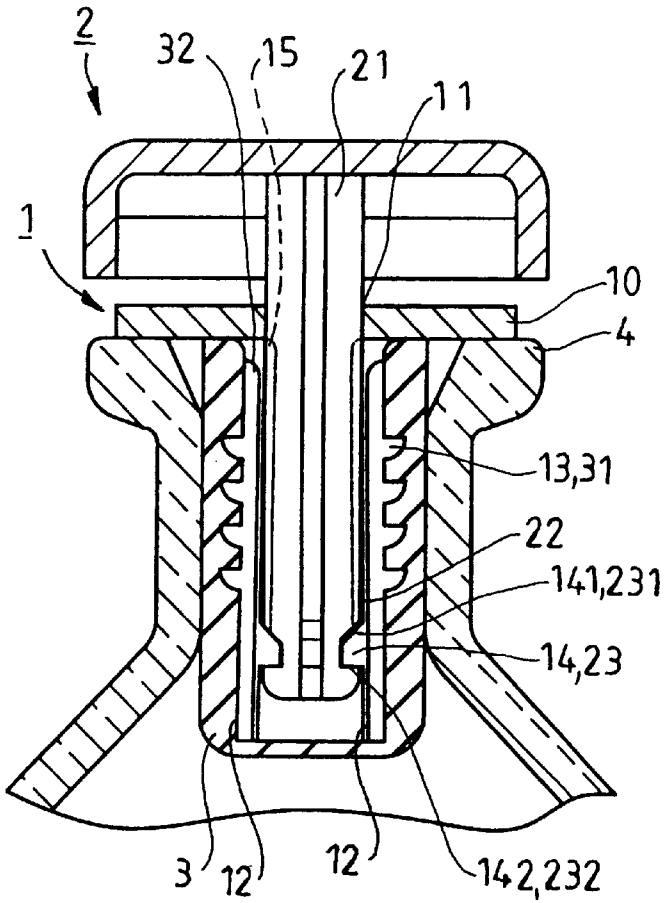
FIG. 4 is a cross-sectional view illustrating the bottle stopper in accordance with the first embodiment of the present invention in opened position and showing the plug in locked position.

Opened operation of the bottle stopper in the bottle neck 4 shall now be described with reference to FIG. 4. Users can pull the plug 2 to retract the leg 12 radially inward until the grooves 23 is re-engaged with the inner flanges 14. The leg 12 retracts radially inward with respect to the longitudinal axis of the body 1 so that it reduces the outer diameter of the jacket 3 such that the bottle stopper can remove from the bottle neck 4. In this manner, it will not involve any mutilation or destruction of any element of the bottle stopper so that it may be reused. The plug 2 is still locked in the body 1 unless the bottle stopper is destroyed. It may provide an appearance and a function of indicating whether the bottle neck has previously opened or the bottle stopper has been used.

Re-sealed operation of the bottle stopper shall now be described with reference to FIG. 3. Users can press the plug 2 to insert into the body 1 of the bottle stopper in the bottle neck 4 so that the outer diameter of the jacket 3 is re-expanded to confront with the inner circumference of the bottle neck 4.

Referring to FIG. 5, reference numerals of the second embodiment has applied the identical numerals of the previous embodiment. The body 1, the plug 2 and the jacket 3 of the second embodiment have the similar configuration and same functions as the previous embodiment and the detailed descriptions are omitted. The plug 2 comprises a head 20 and a singular, hollow rod 21 thereof structurally connected with an underside of the head 20, molded as an integral member. In the design of plug 2 such as that constructed a singular, hollow rod 21, it is a practice to save material and to reduce cost for manufacture. The singular, hollow rod 21 further comprises a groove 23 being adapted to engage with the corresponding inner radically inner flange 14 in order to lock the singular, hollow rod within the space of the legs 12. The groove 23 consists of an upper inclined surface 231 and a lower surface 232.

Figure 6:
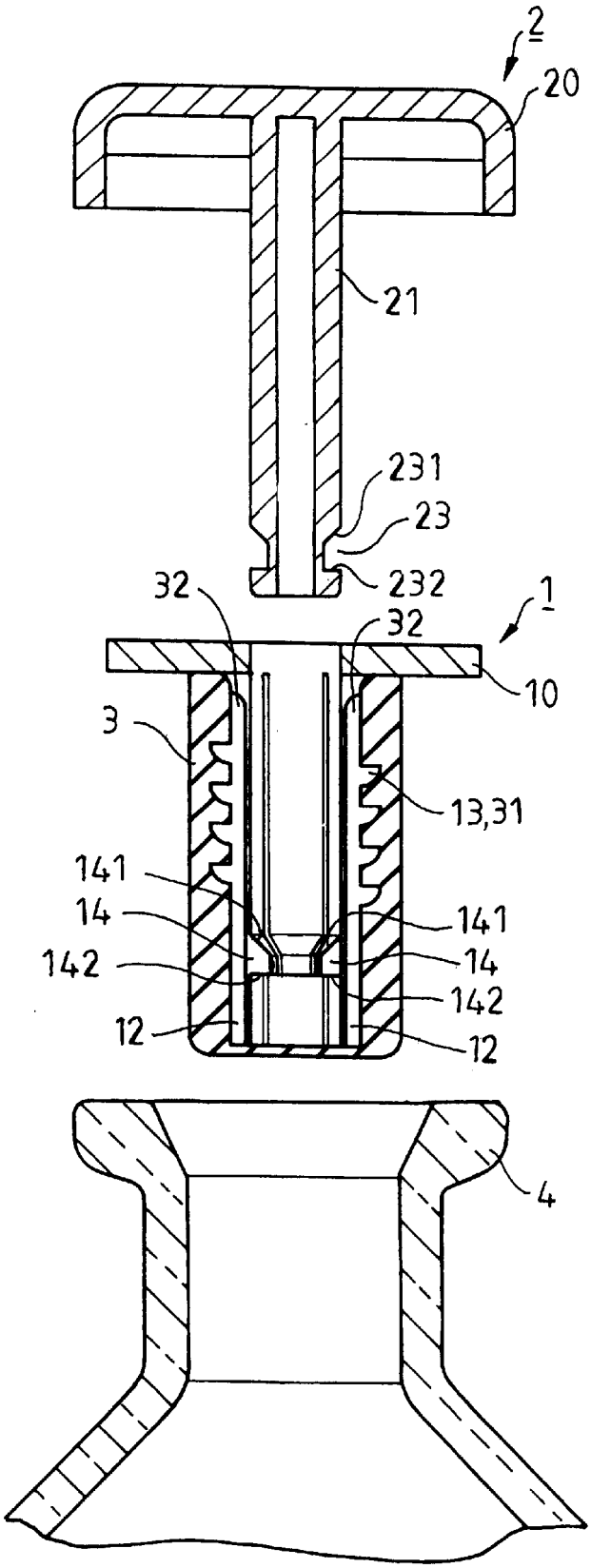
FIG. 6 is an exploded perspective, cross-sectional view of the bottle stopper in accordance with the second embodiment of the present invention.
Figure 7:
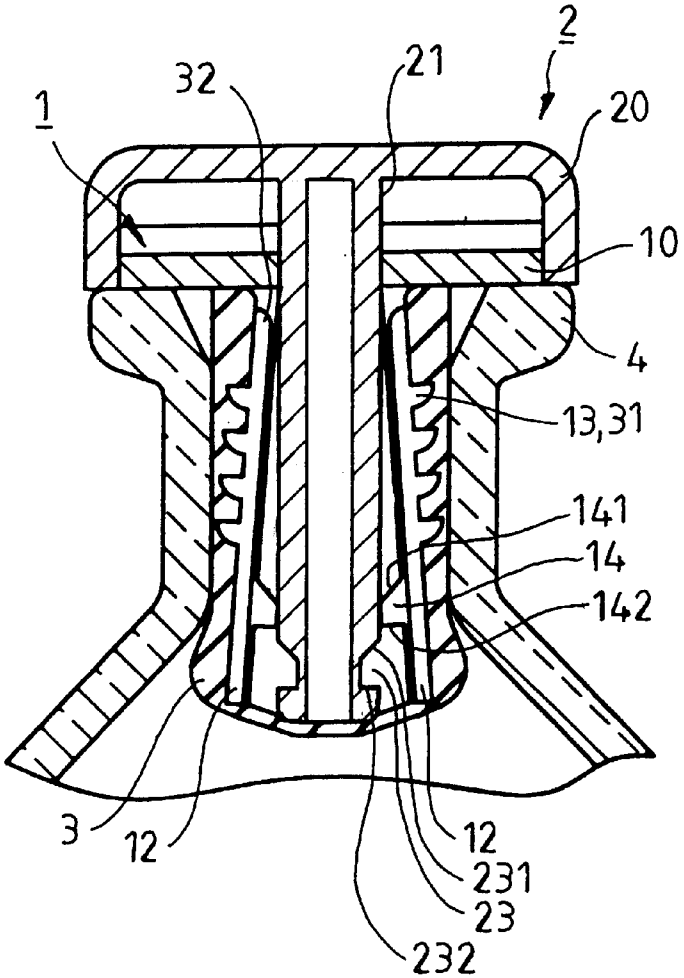
FIG. 7 is a cross-sectional view illustrating the bottle stopper in accordance with the second embodiment of the present invention in sealed position and showing the groove disengaged with the positioning rib.

Assembled operation of the bottle stopper in the bottle neck shall now be described with reference to FIGS. 5 through 7. The body 1 is co-axially inserted into a combined plug and jacket member to form a bottle stopper. As can be seen in FIG. 7, the rod 21 of the plug 2 is inserted into the hole 11 of the body 1. When the radially inner flange 14 is engaged with the groove 23, the engagement of the upper inclined surfaces 141 and 231 are slidable and then the plug 2 can move further into the body 1 if it is pressed. By contrast, the plug 2 cannot be removed from the body 1 because the engagement of the lower surfaces 142 and 232 are not releasable.

Sealed operation of the bottle stopper shall now be described with reference to FIGS. 5 through 8. The bottle stopper is initially inserted into the bottle neck 4. As the plug 2 is axially pressed full-scale or a predetermined distance into the body 1, the radially inner flange 14 is disengaged with the groove 23 such that the outer circumference of the jacket 3 may radially expanded to seal the bottle neck 4. In this manner, as the radially inner flanges 14 of the body 1 are engaged with the singular, hollow rod 21 of the plug 2, the legs 12 are expanded radially outward with respect to the axis of the body 1. Accordingly, the outer circumference of the jacket 3 with a maximum diameter confronts with the inner circumference of the bottle neck 4.

Figure 8:
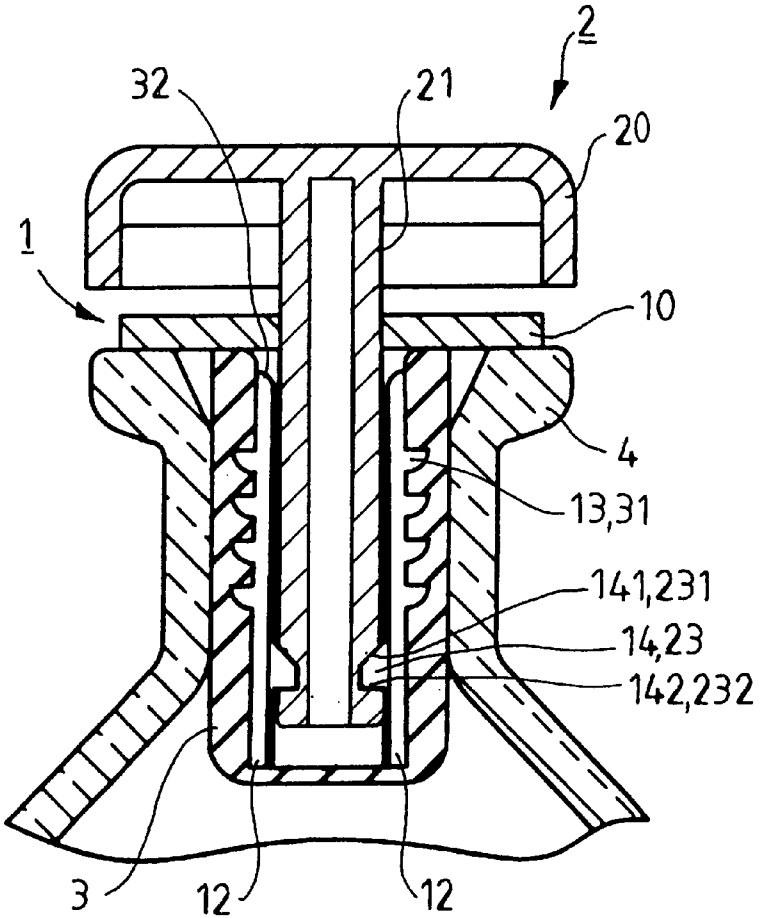
FIG. 8 is a cross-sectional view illustrating the bottle stopper in accordance with the second embodiment of the present invention in opened position and showing the plug in locked position.

Opened operation of the bottle stopper in the bottle neck 4 shall now be described with reference to FIG. 8. Users can pull the plug 2 to retract the leg 12 radially inward until the grooves 23 is re-engaged with the inner flanges 14. The leg 12 retracts radially inward with respect to the longitudinal axis of the body 1 so that it reduces the outer diameter of the jacket 3 such that the bottle stopper can remove from the bottle neck 4. In this manner, it will not involve any mutilation or destruction of any element of the bottle stopper so that it may be reused. The plug 2 is still locked in the body 1 unless the bottle stopper is destroyed. It may provide an appearance and a function of indicating whether the bottle neck has previously opened or the bottle stopper has been used.

Re-sealed operation of the bottle stopper shall now be described with reference to FIG. 7. Users can press the plug 2 to insert into the body 1 of the bottle stopper in the bottle neck 4 so that the outer diameter of the jacket 3 is re-expanded to confront with the inner circumference of the bottle neck 4.

Figure 9:
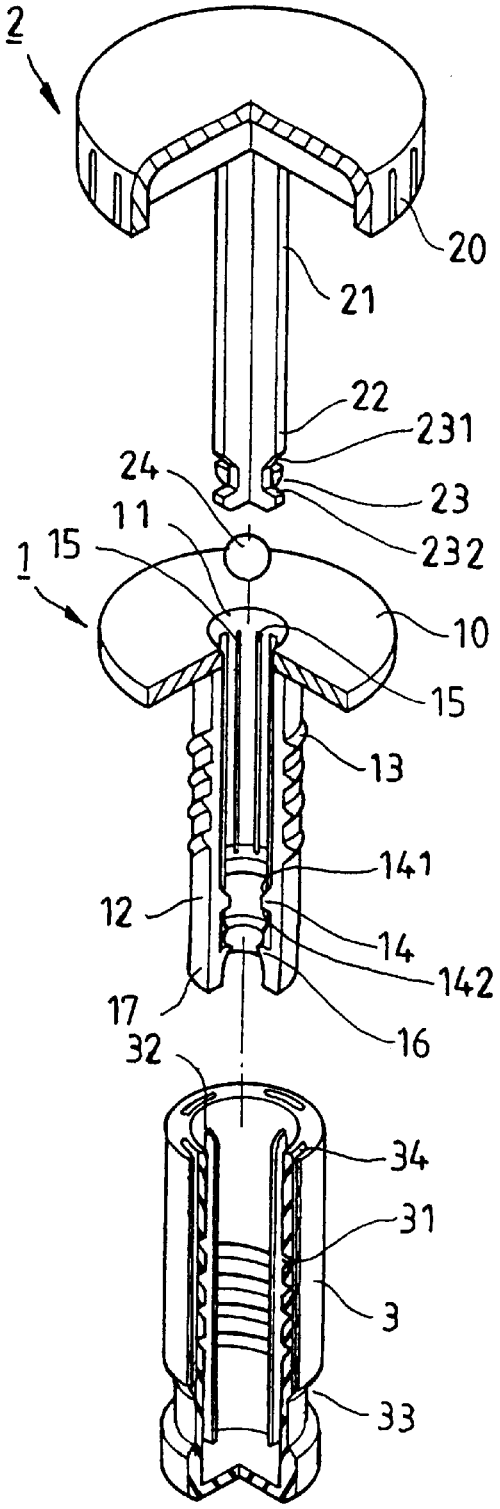
FIG. 9 is an exploded perspective view in partially cut-away of a bottle stopper in accordance with a third embodiment of the present invention.

Referring to FIG. 9, reference numerals of the third embodiment has applied the identical numerals of the previous embodiment. The body 1, the plug 2 and the jacket 3 of the third embodiment have the similar configuration and same functions as the previous embodiment and the detailed descriptions are omitted. The inner circumference of each leg 12 of the body 1 further provides an end flange 16 and an outer concave surface 17 thereof. The end flanges 16 extend around the common longitudinal axis of the body 1 to form a secondarily expanded portion in addition to the primarily expanded portion. Inner surfaces of the end flanges 16 define an inner chamber with the inner flanges 14 and outer concave surfaces 17 define an outer concave co-axially aligned with the inner chamber. The inner chamber and the outer concave are being adapted to receive a ball 24. The outer circumference of jacket 3 further provides an annular groove 33 and a plurality of outlet tubes 34 thereto connected with a rim in order to permit liquid outflow.

Figure 10:
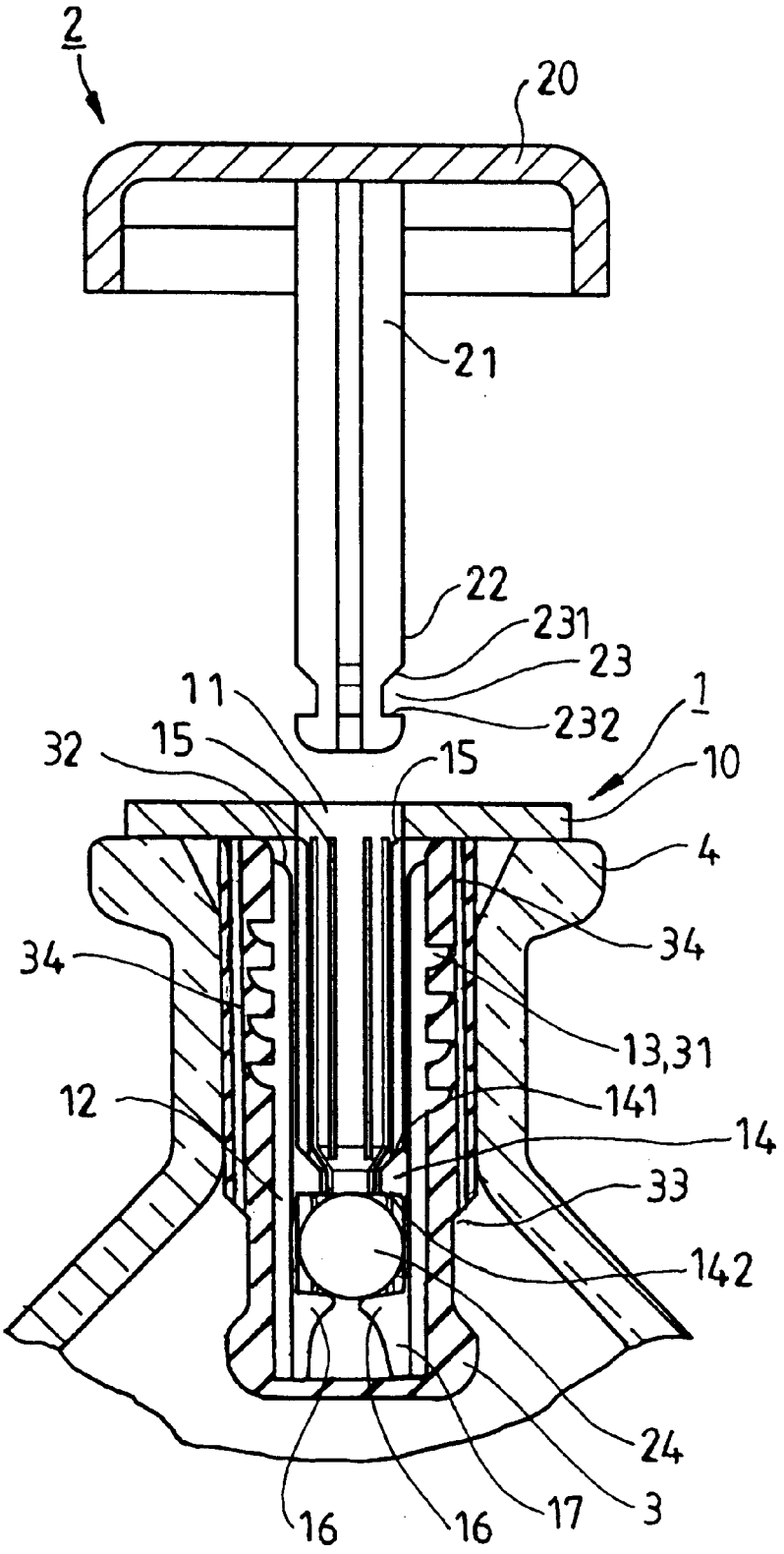
FIG. 10 is an exploded perspective, cross-sectional view of the bottle stopper in accordance with the third embodiment of the present invention.
Figure 11:
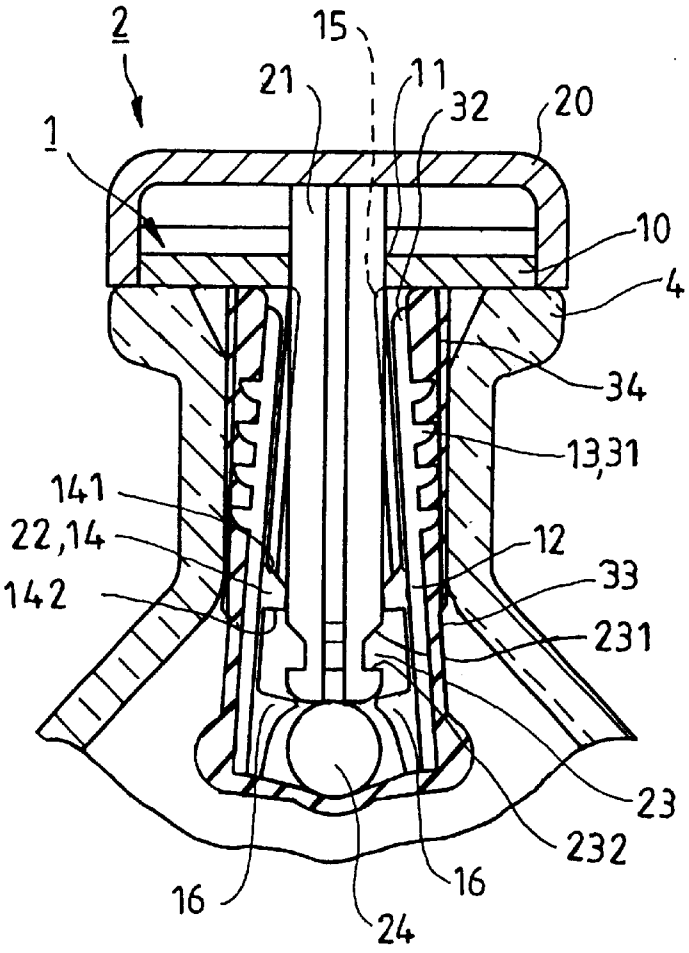
FIG. 11 is a cross-sectional view illustrating the bottle stopper in accordance with the third embodiment of the present invention in sealed position and showing the groove disengaged with the positioning rib.

Sealed/locked operation of the bottle stopper in the bottle neck shall now be described with reference to FIGS. 9 through 11. The ball 24 is prior received in the inner chamber of a combined body and jacket member. The plug 2 is co-axially inserted into the combined body and jacket member which has been initially inserted into the bottle neck 4, as shown in FIG. 10. The plug 2 is axially pressed a predetermined distance into the body 1 and the radially inner flange 14 is then engaged with the longitudinally positioning rib 22 such that the primarily expanded portion of the jacket 3 is radially expanded outward to seal the bottle neck 4. In this manner, the distal end of the plug 2 presses the ball 24 to move from the inner chamber to the outer concave. Accordingly, the primarily expanded portion of the jacket 3 with a maximum diameter confronts with the inner circumference of the bottle neck 4. Meanwhile, the outlet tubes 34 of the jacket 3 are close in some sections corresponding to the primarily expanded portion so that liquid in the bottle cannot outflow through the outlet tubes 34.

Figure 12:
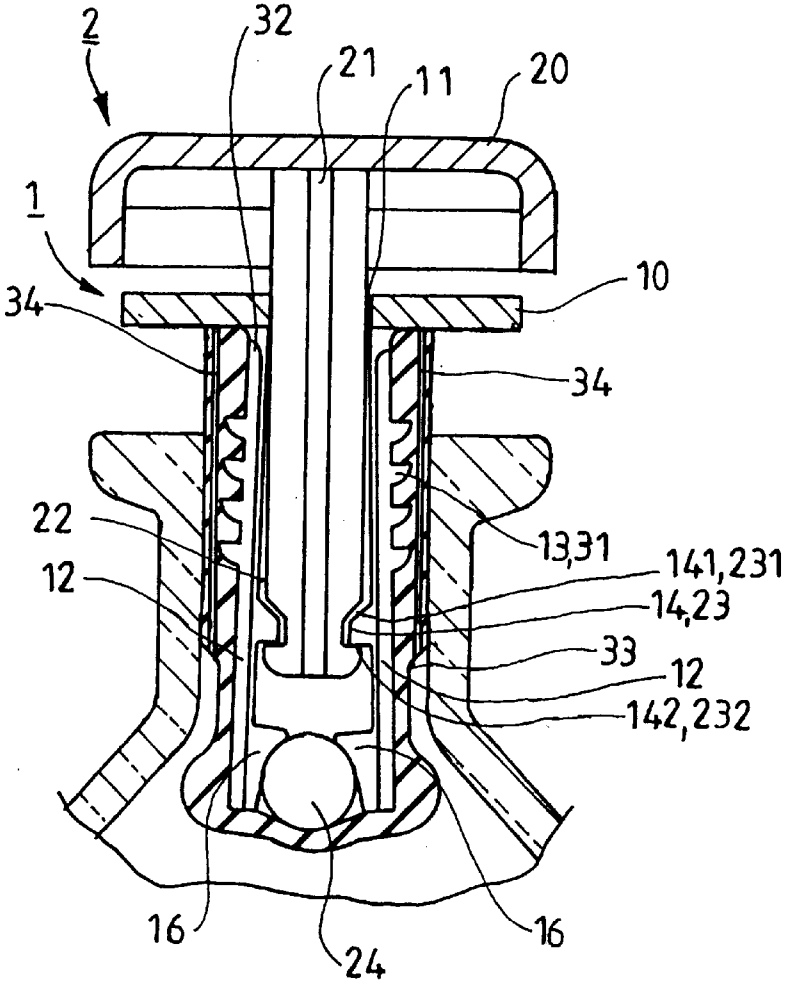
FIG. 12 is a cross-sectional view illustrating the bottle stopper in accordance with the third embodiment of the present invention in opened position and showing the plug in locked position.

Opened operation of the bottle stopper in the bottle neck 4 shall now be described with reference to FIG. 12. Users can pull the plug 2 to retract the leg 12 radially inward until the grooves 23 is re-engaged with the inner flanges 14. The leg 12 retracts radially inward with respect to the longitudinal axis of the body 1 so that it reduces the outer diameter of the jacket 3 to open the outlet tube 34 such that liquid in the bottle can outflow through the outlet tubes 34. Meanwhile, the ball 24 has already remained in the outer concave formed by the end flanges 16 of the body 1. Once the inner flange 14 and the outer concave surfaces 17 are engaged with the groove 23 and the ball 24 respectively, the secondarily expanded portion of the jacket 3 is expanded with a diameter greater than that of the bottle neck 4. Therefore, the bottle stopper cannot remove from the bottle neck 4 but permit liquid outflow. In this manner, it will not involve any mutilation or destruction of any element of the bottle stopper to permit liquid outflow. The bottle stopper is locked in the bottle neck 4 by obstructing of the secondarily expanded portion unless it is destroyed. It provides an appearance and a function of indicating whether the bottle neck has previously opened or the bottle stopper has been used. In this manner, the bottle stopper locked in the bottle neck 4 prevents from illegally reusing.

Re-sealed operation of the bottle stopper in the bottle neck 4 shall now be described with reference to FIG. 11. Users can press the plug 2 to insert into the body 1 of the bottle stopper in the bottle neck 4 so that the radially inner flange 14 is re-engaged with the longitudinally positioning rib 22 such that the primarily expanded portion of the jacket 3 is radially expanded outward to re-seal the bottle neck 4. Thus the outlet tubes 34 is closed to separate the liquid remained in the bottle. In use, the bottle stopper is capable of converting from the secondarily expanded portion in the locked position to the primarily expanded portion in the re-sealed position.

It has been found that the bottle stopper of all embodiments in accordance with the present invention is simplified not only to save material but also to achieve the entire structure, bottling process and reduce manufacture cost.

It has been found that the bottle stopper of the first and third embodiments in accordance with the present invention includes longitudinally positioning ribs and longitudinally guiding grooves structurally engaged therewith so that it enhances sealing effect and increases reliability at reduced cost.

It has been found that the bottle stopper of all embodiments in accordance with the present invention includes an engagement of a plug with a body to lock in the bottle stopper. The bottle stopper has an appearance and a function of indicating whether the bottle neck has previously opened or the bottle stopper has been used.

It has been found that the bottle stopper of the third embodiment in accordance with the present invention is capable of converting between a primarily expanded portion for sealing the bottle neck and a secondarily expanded portion for locking in the bottle neck. The bottle stopper locked in the bottle neck prevents from illegally reusing.

Although the invention has been described in detail with reference to its presently preferred embodiment, it will be understood by one of ordinary skill in the art that various modifications can be made without departing from the spirit and the scope of the invention, as set forth in the appended claims.

What is claimed is:

1. A bottle plug comprising:

a body comprising a plurality of legs which are flexible, an inner circumference of each of the legs providing an inner flange and at least one of the legs is provided with a guiding groove;

a plug comprising a singular, hollow rod being limited within the guiding groove while the plug is inserted into the body, the singular, hollow rod comprising locking grooves being adapted to engage with the inner flange of the body to lock the plug in the body, and the guide groove prevents rotation of the plug in the body;

a jacket combined with the body to form a combined body and jacket member, an outer circumference of the jacket providing an expanded portion actuated by radial expansion of the legs;

when the locking grooves of the singular, hollow rod is correspondingly engaged with the inner flanges of the legs, the outer circumference of the jacket can conveniently be inserted into a bottle neck; and when the plug is pressed and the singular hollow rod is engaged with the inner flanges of the legs, the outer circumference of the jacket is expanded to seal the bottle neck.

2. The bottle stopper as claimed in claim 1, wherein an inclined surface of each of the locking grooves is engaged with a respective inclined surface of each of the inner flanges, the disengagement of two of the respective inclined surfaces thereof is capable of converting the outer circumference of the jacket into the expanded portion.

3. The bottle stopper as claimed in claim 1, wherein a surface of each of the grooves is engaged with a corresponding surface of each of the inner flanges, the engagement of two of the surfaces thereof is adapted to lock the plug in the body.

4. A bottle plug comprising:

a body comprising a plurality of legs which are flexible, an inner circumference of each leg comprising a guiding groove and an inner flange;

a plug comprising a plurality of positioning ribs being limited within the guiding grooves while the plug is inserted into the body, each of the positioning ribs providing a locking groove adapted to engage with the inner flange to lock the plug in the body;

a jacket combined with the body to form a combined body and jacket member, an outer circumference of the jacket providing an expanded portion actuated by radial expansion of the legs;

wherein the guiding grooves guide the positioning ribs in order to prevent rotation of the plug in the body;

when the locking grooves of the ribs correspondingly engage with the inner flanges of the legs, the outer circumference of the jacket can conveniently be inserted into a bottle neck; and when the plug is pressed and the ribs are correspondingly engaged with the inner flange flanges of the legs, the outer circumference of the jacket is expanded to seal the bottle neck.

5. The bottle stopper as claimed in claim 4, wherein an inclined surface of each of the locking grooves is engaged with an inclined surface of each of the inner flanges, the disengagement of two of the inclined surfaces thereof is capable of converting the outer circumference of the jacket into the expanded portion.

6. The bottle stopper as claimed in claim 4, wherein a surface of each of the locking grooves is engaged with a respective surface of each of the inner flanges, the engagement of two of the surfaces thereof is adapted to lock the plug in the body.

7. The bottle stopper as claimed in claim 4, wherein the positioning ribs are provided for saving material to reduce manufacture cost.

8. The bottle stopper as claimed in claim 4, wherein four of the legs divide a radially outer circumference of the body into four identical sections which extends at least approximately 90° arc length, four of the positioning ribs separate a radially outer periphery of the plug into four identical spaces in the range of at lest approximately 90° arc length.

9. A bottle stopper comprising:

a body comprising a plurality of legs which are flexible, an inner circumference of each of the legs providing an inner flange and an end flange being adapted to form an inner chamber in which to receive a ball, the end flange further comprising a concave surface being adapted to form an outer concave in which to receive the ball;

a plug providing a plurality of locking grooves being adapted to correspondingly engage with the inner flanges to lock the plug in the body;

a jacket combined with the body to form a combined body and jacket member, an outer circumference of the jacket providing a primarily expanded portion and a secondarily expanded portion actuated by radially expanding the legs;

when the locking grooves of the plug correspondingly engage with the inner flanges of the legs, the outer circumference of the jacket can conveniently be inserted into a bottle neck;

when the plug is pressed and engaged with the inner flanges of the body, the primarily expanded portion of the jacket is expanded to seal the bottle neck; and when the ball is engaged with the outer concave of the body, the secondarily expanded portion of the jacket is expanded to lock the bottle stopper in the bottle neck, the outer circumference of the jacket is capable of converting between a primarily expanded portion and a secondarily expanded portion.

10. The bottle stopper as claimed in claim 9, further comprises a plurality of outlet tubes connected with a rim of the jacket in order to permit liquid outflow.

11. The bottle stopper as claimed in claim 9, wherein the guiding grooves of the legs are configured to limit the positioning ribs of the plug, the guiding groove guides the positioning rib in order to prevent rotation of the plug in the body.

12. The bottle stopper as claimed in claim 9, wherein four of the legs divide a radial outer circumference of the body into four identical sections which extends at least approximately 90° arc length, four positioning ribs separate a radial outer periphery of the plug into four identical spaces in the range of at least approximately 90° arc length.

13. The bottle stopper as claimed in claim 9, wherein an inclined surface of each of the locking grooves is engaged with an inclined surface of each of the inner flanges, the disengagement of two of the inclined surfaces thereof is capable of converting the outer circumference of the jacket into the expanded position.

14. The bottle stopper as claimed in claim 9, wherein a surface of each of the locking grooves is engaged with a surface of each of the inner flanges, the engagement of two of the surfaces thereof is adapted to lock the plug in the body.

* * * * *